US010522915B2

(12) United States Patent
Kenkel

(10) Patent No.: US 10,522,915 B2
(45) Date of Patent: Dec. 31, 2019

(54) MULTI-BAND SLOTTED PLANAR ANTENNA

(71) Applicant: Shure Acquisition Holdings, Inc., Niles, IL (US)

(72) Inventor: Mark Allen Kenkel, Schaumburg, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 103 days.

(21) Appl. No.: 15/422,108

(22) Filed: Feb. 1, 2017

(65) Prior Publication Data

US 2018/0219292 A1 Aug. 2, 2018

(51) Int. Cl.
*H01Q 1/38* (2006.01)
*H01Q 9/04* (2006.01)
(Continued)

(52) U.S. Cl.
CPC ..... *H01Q 9/0414* (2013.01); *H01Q 1/243* (2013.01); *H01Q 1/48* (2013.01); *H01Q 5/30* (2015.01);
(Continued)

(58) Field of Classification Search
CPC ..... H01Q 9/0414; H01Q 5/30; H01Q 1/48; H01Q 9/0428; H01Q 13/106
See application file for complete search history.

(56) References Cited

U.S. PATENT DOCUMENTS 5,912,647 A * 6/1999 Tsuru ..... H01Q 1/22 343/700 MS
5,917,450 A * 6/1999 Tsunekawa ..... H01Q 9/0414 343/700 MS
(Continued)

FOREIGN PATENT DOCUMENTS

CN 1177504 11/2004
CN 1177505 11/2004
(Continued)

OTHER PUBLICATIONS

Ilvonen, et al., "Multiband Frequency Reconfigurable 4G Handset Antenna with MIMO Capability," Progress in Electromagnetics Research, vol. 148, pp. 233-243, 2014.
(Continued)

*Primary Examiner* — Dieu Hien T Duong
*Assistant Examiner* — Bamidele A Jegede
(74) *Attorney, Agent, or Firm* — William J. Lenz, Esq.; Neal, Gerber & Eisenberg LLP

(57) ABSTRACT

Slotted planar inverted F antennas are provided that can be operated in multiple frequency bands and are usable with electrically small ground planes. The antennas may have multiple planar levels and the impedance of each level (corresponding to a particular frequency band) may be independently adjustable. The antennas may have a self-supporting structure that does not require a separate frame. The antennas may further have a right hand circular polarization hemisphere and a left hand circular polarization hemisphere. Multiple antennas may be situated orthogonally to one another without adversely affecting their performance, due to the hemispherical polarizations, and thereby provide polarization diversity. The number of antennas and associated components used in wireless communications devices may be reduced by using the antennas, as well as reducing the amount of space needed for the antennas.

19 Claims, 2 Drawing Sheets

(51) Int. Cl.
*H01Q 1/48* (2006.01)
*H01Q 5/30* (2015.01)
*H01Q 13/10* (2006.01)
*H01Q 1/24* (2006.01)

(52) U.S. Cl.
CPC ..... *H01Q 9/0421* (2013.01); *H01Q 9/0428* (2013.01); *H01Q 13/10* (2013.01); *H01Q 13/106* (2013.01)

(56) References Cited

U.S. PATENT DOCUMENTS 5,943,020 A * 8/1999 Liebendoerfer ..... H01Q 1/2258 343/702
6,008,764 A * 12/1999 Ollikainen ..... H01Q 9/0414 343/700 MS
6,049,314 A * 4/2000 Munson ..... H01Q 1/38 343/700 MS
6,456,243 B1 * 9/2002 Poilasne ..... H01Q 1/38 343/700 MS
6,501,427 B1 12/2002 Lilly et al.
7,081,859 B2 7/2006 Miyoshi et al.
7,170,452 B2 1/2007 Yang
7,265,720 B1 9/2007 Ponce de Leon et al.
7,532,165 B2 5/2009 Kim et al.
7,705,786 B2 4/2010 Iellici et al.
8,325,097 B2 12/2012 McKinzie, III et al.
8,610,635 B2 12/2013 Huang et al.
8,902,113 B2 12/2014 Morris, III
8,957,827 B1 2/2015 Lee et al.
2002/0163470 A1 * 11/2002 Nagumo ..... H01Q 1/22 343/700 MS
2002/0175871 A1 11/2002 Johansson
2002/0183013 A1 12/2002 Auckland et al.
2003/0078037 A1 4/2003 Auckland et al.
2003/0189522 A1 * 10/2003 Zeilinger ..... H01Q 9/0421 343/702
2004/0155823 A1 * 8/2004 Kossiavas ..... H01Q 1/243 343/702
2004/0169611 A1 * 9/2004 Korva ..... H01Q 1/243 343/770
2005/0184914 A1 * 8/2005 Ollikainen ..... H01Q 1/243 343/702
2005/0195119 A1 9/2005 Gaucher
2005/0259024 A1 * 11/2005 Hung ..... H01Q 1/36 343/770
2005/0264455 A1 * 12/2005 Talvitie ..... H01Q 1/243 343/702
2006/0012524 A1 * 1/2006 Mierke ..... H01Q 1/243 343/700 MS
2008/0252521 A1 10/2008 Sabet et al.
2009/0174604 A1 * 7/2009 Keskitalo ..... H01Q 1/243 343/700 MS
2009/0256754 A1 * 10/2009 Tsai ..... H01Q 1/2275 343/700 MS
2011/0193758 A1 8/2011 Liu et al.
2013/0069841 A1 * 3/2013 Lee ..... H01Q 1/521 343/846
2013/0229318 A1 * 9/2013 Ng ..... H01Q 9/0421 343/770
2014/0022132 A1 1/2014 Badaruzzaman et al.
2014/0347241 A1 * 11/2014 Kim ..... H01Q 1/243 343/845
2015/0061960 A1 3/2015 Liou et al.
2015/0311883 A1 10/2015 Bakalski
2016/0126619 A1 5/2016 Tenbroek et al.
2016/0134016 A1 5/2016 Hsu et al.
2016/0149303 A1 * 5/2016 Mcgough ..... H01Q 5/357 343/767
2016/0218431 A1 7/2016 Gaddi et al.

FOREIGN PATENT DOCUMENTS

| | | |
|---|---|---|
| CN | 102299414 | 12/2011 |
| CN | 202333144 | 7/2012 |
| CN | 203480532 | 3/2014 |
| CN | 104103913 | 10/2014 |
| CN | 204809376 | 11/2015 |
| EP | 1911122 | 4/2008 |
| EP | 2750247 | 7/2014 |
| KR | 20080019964 | 3/2008 |
| WO | 2002037603 | 5/2002 |
| WO | WO2003094290 | 11/2003 |
| WO | WO2007098810 | 9/2007 |
| WO | WO2015001181 | 1/2015 |
| WO | WO2015011468 | 1/2015 |
| WO | WO2015077483 | 5/2015 |

OTHER PUBLICATIONS

Nepa, et al., "A Compact Multi Band Pifa for Wireless LAN Mobile Terminals," 11th International Symposium on Antenna Technology and Applied Electromagnetics [ANTEM 2005], Jun. 2005, pp. 1-4.
See, et al., "Design of a Pifa with Parasitic F-Element Miniaturized Antenna Assembly for Lower Band Ultra-Wideband and IEEE 802.11a Applications," Microwave and Optical Technology Letters, vol. 53, No. 9, Sep. 2011, pp. 1970-1974.
International Search Report and Written Opinion for PCT/US2018/015848 dated May 3, 2018.

* cited by examiner

MULTI-BAND SLOTTED PLANAR ANTENNA

TECHNICAL FIELD

This application generally relates to a multi-band slotted planar antenna. In particular, this application relates to a slotted planar inverted F antenna that can be operated in multiple frequency bands and may be usable with electrically small ground planes.

BACKGROUND

Wireless communication devices, such as wireless microphones, wireless audio transmitters, wireless audio receivers, and wireless earphones, include antennas for communicating radio frequency (RF) signals without the need for a physical cable. The RF signals can include digital or analog signals, such as modulated audio signals, data signals, and/or control signals. Wireless communication devices are used for many functions, including, for example, enabling broadcasters and other video programming networks to perform electronic news gathering activities at locations in the field and the broadcasting of live sports events. Wireless communication devices are also used by, for example, stage performers, singers, and/or actors in theaters, music venues, and film studios, and public speakers at conventions, corporate events, houses of worship, schools, and sporting events.

Wireless communications devices are often low profile and small so that the size of the devices is reduced for aesthetic reasons. It may also be desirable to place the antenna within the devices, instead of having the antenna on an exterior of the devices. The antennas included in devices can be designed to operate in one or more certain spectrum bands, and may be designed to cover either a discrete set of frequencies within the spectrum band or an entire range of frequencies in the band. For example, devices used in a conferencing environment may communicate using 2.4 GHz or 5 GHz Wi-Fi bands for sending and receiving various data and control signals. In addition, the polarization of antennas and their radiation pattern in wireless communications devices may vary as the orientation of the devices changes, e.g., when a user holds a device to their ear or places it on a table, etc.

Moreover, antenna design considerations can limit the number of antennas that are included within a single device (e.g., due to a lack of available space), while aesthetic design considerations can restrict the type of antennas that can be used. For example, whip antennas are traditionally good performers and by virtue of its external design, take up very little internal device space. However, these antennas can be expensive, distracting, and aesthetically unappealing, especially when they are long in length. As another example, certain devices may be physically small, which can limit the size of the ground plane for the antennas. For devices that need to communicate at several frequencies, typical antennas may not fit within the devices and/or may have poor efficiency.

Accordingly, there is an opportunity for antennas that address these concerns. More particularly, there is an opportunity for a multi-band slotted planar inverted F antenna (PIFA) that can be operated in multiple frequency bands, while being usable with electrically small ground planes that can fit within relatively small wireless communications devices.

SUMMARY

The invention is intended to solve the above-noted problems by providing, among other things, (1) an antenna assembly having an antenna with multiple plane elements that are each configured for operation in different frequency bands; and (2) an antenna assembly having two antennas positioned orthogonally to one another, where each antenna has multiple plane elements that are each configured for operation in different frequency bands.

In an embodiment, an antenna assembly includes a ground plane and an antenna. The antenna includes a first plane element, a second plane element, a first grounding element, a second grounding element, a feed element, and a connecting element. The first plane element is generally parallel with the ground plane and is configured for operation in a first frequency band, and includes a first strip, a second strip, a joining strip extending between the first and second strips, and a generally linear slot formed between the first and second strips. The first grounding element extends downwardly from the first strip and is electrically coupled to the ground plane, and the second grounding element extends downwardly from the second strip and is electrically coupled to the ground plane. The feed element extends downwardly from the joining strip at a first end of the slot. The second plane element is generally parallel with the first plane element and the ground plane and is configured for operation in a second frequency band. The connecting element extends downwardly from the second plane element to the first plane element.

In another embodiment, an antenna assembly includes a ground plane, a first antenna, and a second antenna positioned orthogonally to the first antenna. Each of the first and second antennas includes a first plane element, a second plane element, a first grounding element, a second grounding element, and a feed element. The first plane element is generally parallel with the ground plane, is configured for operation in a first frequency band, and includes a generally linear slot. The first grounding element extends downwardly from the first plane element and is electrically coupled to the ground plane. The second grounding element extends downwardly from the first plane element and is electrically coupled to the ground plane. The feed element extends generally perpendicularly from the second grounding element to the connecting element and a second portion. The second plane element is connected to the first plane element, is generally parallel with the first plane element and the ground plane, and is configured for operation in a second frequency band.

These and other embodiments, and various permutations and aspects, will become apparent and be more fully understood from the following detailed description and accompanying drawings, which set forth illustrative embodiments that are indicative of the various ways in which the principles of the invention may be employed.

DETAILED DESCRIPTION

Figure 1:
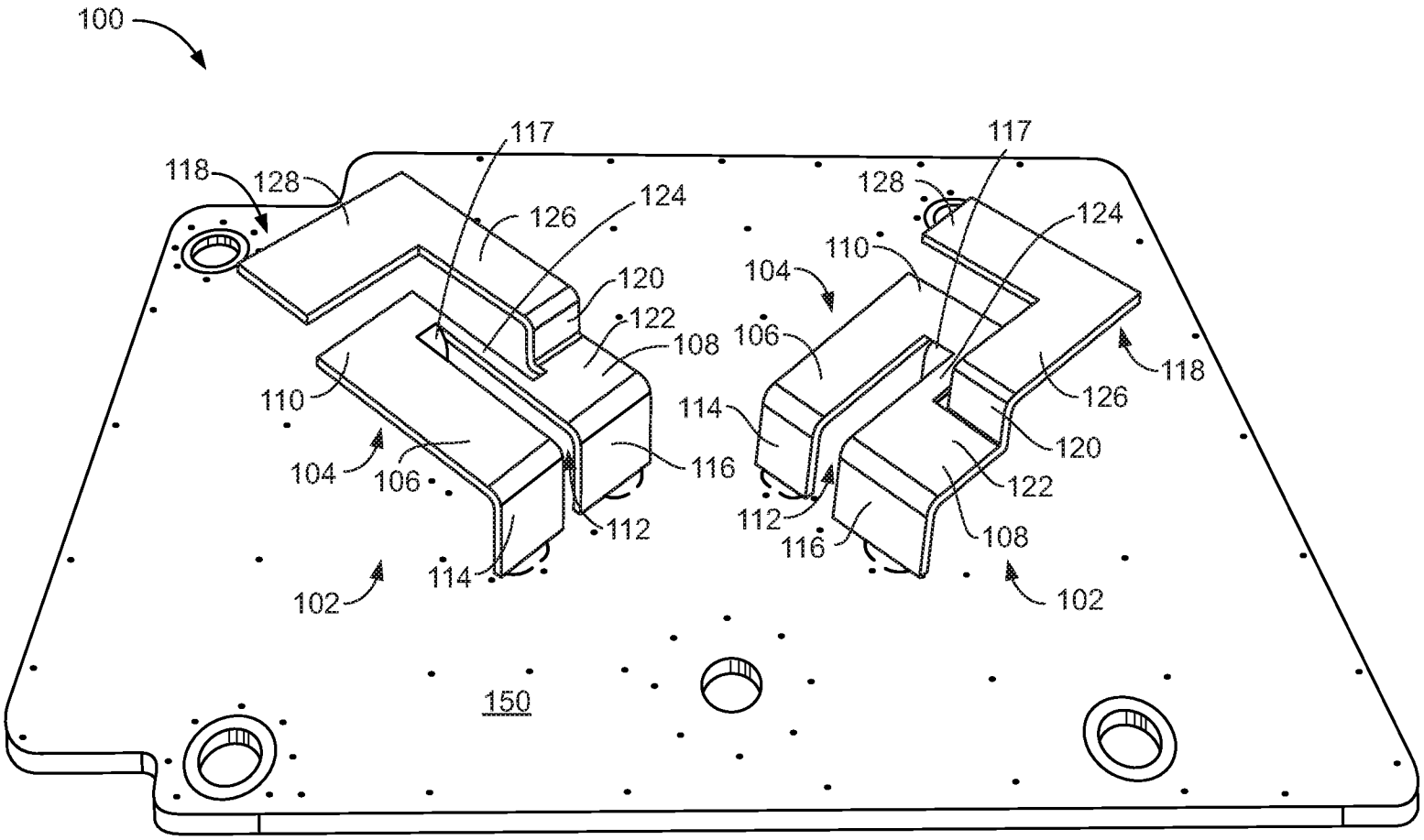
FIG. 1 is a perspective view of an antenna assembly having two antennas positioned orthogonally to one another on a ground plane, in accordance with some embodiments.

The description that follows describes, illustrates and exemplifies one or more particular embodiments of the invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but also other embodiments that may come to mind in accordance with these principles. The scope of the invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers, such as, for example, in cases where such labeling facilitates a more clear description. Additionally, the drawings set forth herein are not necessarily drawn to scale, and in some instances proportions may have been exaggerated to more clearly depict certain features. Such labeling and drawing practices do not necessarily implicate an underlying substantive purpose. As stated above, the specification is intended to be taken as a whole and interpreted in accordance with the principles of the invention as taught herein and understood to one of ordinary skill in the art.

The antenna assemblies described below can enable an antenna to be operated in multiple frequency bands, while being placed on an electrically small ground plane. By using the antenna assemblies described herein, the number of antennas and associated components used in wireless communications devices may be reduced, as well as reducing the amount of space needed for the antennas. The antenna can have multiple planar levels that each operate in a particular frequency band. The impedance of each level (corresponding to a particular frequency band) may be independently adjustable.

The antenna also may have a self-supporting structure that does not require a separate frame, due to the placement of the grounding elements and feed element upon the ground plane. Because there is no separate frame, dielectric losses may be reduced and the efficiency of the antenna may be improved. Furthermore, the feed element for the antenna may be placed in the center of the antenna, which can provide a right hand circular polarization hemisphere and a left hand circular polarization hemisphere. In some embodiments, multiple antennas can be placed orthogonally to one another without impacting their performance. The use of such multiple antennas can provide polarization diversity to improve overall performance, such as by reducing the chance of signal loss due to changes in the orientation of the device including the antennas. The particular placement of the feed element can allow adjustment of the impedance of the antenna as well.

Figure 2:
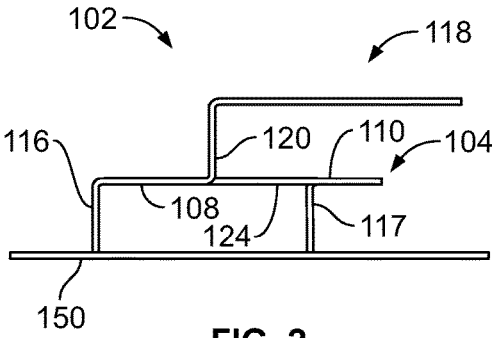
FIG. 2 is a side view of one of the antennas of FIG. 1, in accordance with some embodiments.
Figure 3:
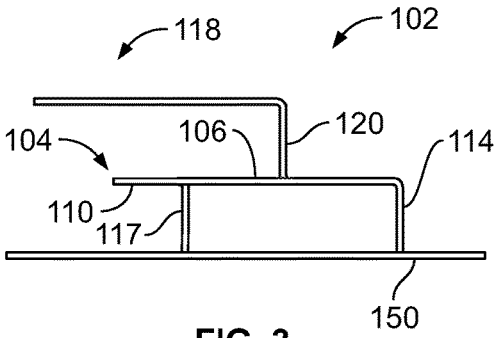
FIG. 3 is a side view of one of the antennas of FIG. 1 from the opposite side of the view shown in FIG. 2, in accordance with some embodiments.
Figure 4:
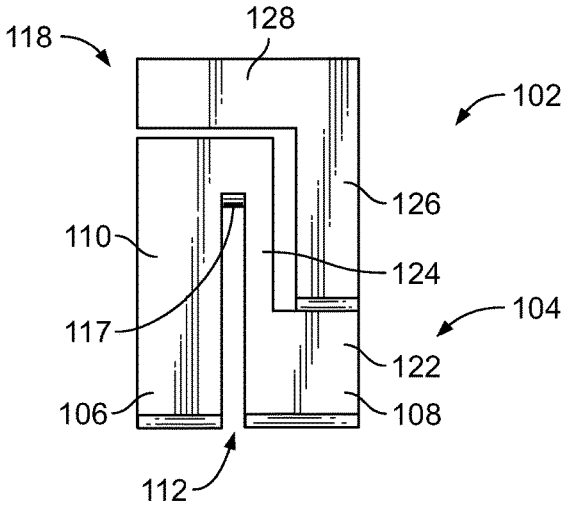
FIG. 4 is a top view of one of the antennas of FIG. 1, in accordance with some embodiments.

FIG. 1 illustrates a perspective view of an exemplary antenna assembly 100 having two antennas 102 situated on a ground plane 150. The antenna assembly 100 may be utilized in a wireless communications device, for example. Each of the antennas 102 may transmit RF signals and be connected to the same or different feeds via their respective feed element 117. In the particular embodiment shown in FIG. 1, the two antennas 102 are positioned orthogonally to one another so that the performance of each antenna 102 is not negatively impacted by the other antenna 102, as described in more detail below. In other embodiments, a single antenna 102 may be situated on the ground plane 150. FIG. 2 illustrates a side view of an antenna 102, FIG. 3 illustrates a side view of the antenna 102 from the opposite side of the view shown in FIG. 2, and FIG. 4 illustrates a top view of the antenna 102. The antenna 102 may be made of a suitable metal material.

The antenna 102 may be a type of planar inverted-F antenna (PIFA) that has two plane elements 104, 118 that are each positioned generally parallel with the ground plane 150, and two grounding elements 114, 116 at an end of the antenna 102. The antenna 102 may be fed via a feed element 117 that can be situated a distance away from the grounding elements 114, 116. The grounding elements 114, 116 may be electrically coupled to the ground plane 150 and may extend downwardly from the first plane element 104 to the ground plane 150. The antenna 102 may be self-supporting such that a separate frame is not needed to support the structure of the antenna 102. In particular, the antenna 102 may be physically supported by the grounding elements 114, 116 and the feed element 117 atop the ground plane 150. Accordingly, because there is no separate frame, dielectric losses due to such a frame may be eliminated, which can improve the efficiency of the antenna 102.

The plane elements 104, 118 may be configured to operate at different frequencies. As such, the feed to the antenna 102 may include RF signals for transmission on both of the plane elements 104, 118. The RF signals may contain audio signals or data signals modulated by analog and/or digital modulation schemes, for example. The signals may have been modulated by an analog or digital RF transceiver/transmitter (not shown) and amplified by a properly matched power amplifier (not shown). In some embodiments, the antenna 102 may be tuned so that the resonance of each of the plane elements 104, 118 may be at a particular desired frequency. Tuning networks (not shown) that include varactor diodes or digitally tuned capacitors, for example, may be used to concurrently or independently tune the plane elements 104, 118 of the antenna 102. In embodiments, the feed element 117 may have an impedance of 50 ohms for both of the plane elements 104, 118 such that a separate matching network is not needed. Varying the particular location of the feed element 117 may allow the impedance of both of the plane elements 104, 118 to be jointly adjusted.

A first plane element 104 of the antenna 102 may include a first strip 106, a second strip 108, and a joining strip 110 that connects the first strip 106 and the second strip 108. The first strip 106, the second strip 108, and the joining strip 110 may generally be in the same plane such that the first plane element 104 may be generally parallel with the ground plane 150. A generally linear slot 112 may be formed between the first strip 106 and the second strip 108. The slot 112 may have an open end formed between the grounding elements 114, 116, and the feed element 117 may be situated at the other end of the slot 112. As can be seen in the figures, the feed element 117 may be situated approximately in the center of the antenna 102 and may extend downwardly from the joining strip 110 towards the ground plane 150. When the slot 112 and feed element 117 are created during the manufacturing process, e.g., by stamping a relatively small metal sheet, wasted material may be minimized due to their central location. This is in contrast to traditional PIFAs that typically require a larger metal sheet where a feed element is bent down from a side of the sheet during manufacture. In an embodiment, the first plane element 104 may be configured to operate using a 5 GHz frequency band. In other embodiments, the first plane element 104 may be configured to operate in other suitable frequency bands.

The first strip 106 of the first plane element 104 may extend generally perpendicularly from the first grounding element 114 to the joining strip 110. The first strip 106 may be generally parallel with the slot 112 and with the second strip 108. The second strip 108 of the first plane element 104 may extend generally perpendicularly from the second grounding element 116 to the joining strip 110 and to a connecting element 120. The connecting element 120 may connect the first plane element 104 and the second plane element 118, and extend downwardly from a first portion 126 of the second plane element 118 to the second strip 108.

In embodiments, the second strip 108 of the first plane element 104 may be generally L-shaped, and include a first portion 122 that extends generally perpendicularly from the second grounding element 116 to the connecting element 120, and a second portion 124 that extends from the first portion 122 to the joining strip 110. The second portion 124 may be generally parallel with the slot 112. The joining strip 110 may extend between the first strip 106 and the second strip 108, and in particular, extend from the first strip 106 to the second portion 124 of the second strip 108.

The second plane element 118 of the antenna 102 may include a first portion 126 and a second portion 128. The first portion 126 and the second portion 128 may generally be in the same plane such that the second plane element 118 may be generally parallel with the ground plane 150 and with the first plane element 104. In embodiments, the second plane element 118 may be generally L-shaped. In particular, the first portion 126 may extend generally perpendicularly from the connecting element 120 and be generally parallel with the slot 112, and the second portion 128 may extend from an end of the first portion 126 and be generally perpendicular to the slot 112. The connecting element 120 may connect the first plane element 104 and the second plane element 118, and extend downwardly from the first portion 126 to the second strip 108 of the first plane element 104. In an embodiment, the second plane element 118 may be configured to operate using a 2.4 GHz frequency band. In other embodiments, the second plane element 118 may be configured to operate in other suitable frequency bands.

The first and second plane elements 104, 118 are shown in the figures at different levels, i.e., within different planes that are parallel with one another and with the ground plane 150. The impedance of each of the first and second plane elements 104, 118 may be independently adjustable by changing the widths of the various strips and portions 106, 108, 110, 126, 128 of the plane elements 104, 118. In some embodiments, the first and second plane elements 104, 118 may be at the same level, i.e., within the same plane, and the connecting element 120 may be unnecessary. It is also contemplated that additional levels may be utilized for operation in additional frequency bands, i.e., more than two. The dimensions and geometries of the various strips, elements, and/or slots as shown in the figures are exemplary and may vary depending on the requirements of a particular device or application.

The antenna 102 may have a right hand circular polarization hemisphere and a left hand circular polarization hemisphere, due to the placement of the slot 112 and the feed element 117. In particular, the polarization hemispheres may be on either side of a plane that bisects the length of the antenna (i.e., along the slot 112) and is perpendicular to the ground plane 150. Accordingly, the area of the antenna 102 to the left of the slot 112 may have a left hand circular polarization and the area of the antenna 102 to the right of the slot 112 may have a right hand circular polarization. This hemispherical polarization may allow the antenna assembly 100 shown in FIG. 1 to have polarization diversity because the two antennas 102 are positioned orthogonally to one another and will generally not interfere with one another.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) were chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the embodiments as determined by the appended claims, as may be amended during the pendency of this application for patent, and all equivalents thereof, when interpreted in accordance with the breadth to which they are fairly, legally and equitably entitled.

The invention claimed is:

1. An antenna assembly, comprising:

a ground plane; and an antenna, comprising:

a first plane element generally parallel with the ground plane and configured for operation in a first frequency band, the first plane element comprising a first strip, a second strip, a joining strip extending between the first and second strips, and a generally linear slot formed between the first and second strips;

a first grounding element extending downwardly from the first strip and electrically coupled to the ground plane;

a second grounding element extending downwardly from the second strip and electrically coupled to the ground plane;

a feed element extending downwardly from the joining strip at a first end of the slot;

a second plane element generally parallel with the first plane element and the ground plane and configured for operation in a second frequency band; and a connecting element extending downwardly from the second plane element to the first plane element.

2. The antenna assembly of claim 1, wherein:

the first strip of the first plane element extends generally perpendicularly from the first grounding element to the joining strip; and the second strip of the first plane element extends generally perpendicularly from the second grounding element to the joining strip and the connecting element.

3. The antenna assembly of claim 1, wherein the second strip of the first plane element is generally L-shaped when viewed in a direction transverse to the ground plane.

4. The antenna assembly of claim 1, wherein the second strip of the first plane element comprises:

a first portion extending generally perpendicularly from the second grounding element to the connecting element and a second portion; and the second portion extending from the first portion to the joining strip and generally parallel with the slot.

5. The antenna assembly of claim 1, wherein the second plane element is generally L-shaped when viewed in a direction transverse to the ground plane.

6. The antenna assembly of claim 1, wherein the second plane element comprises:

a first portion extending generally perpendicularly from the connecting element and generally parallel with the slot; and a second portion extending from an end of the first portion and generally perpendicular to the slot.

7. The antenna assembly of claim 1, wherein the slot is open at a second end formed between the first and second grounding elements, the second end at an opposite end of the first end of the slot.

8. The antenna assembly of claim 1, wherein a first area of the antenna on one side of the slot has a right hand circular polarization and a second area of the antenna on the other side of the slot has a left hand circular polarization.

9. The antenna assembly of claim 1, wherein the first frequency band comprises a 5 GHz operating band and the second frequency band comprises a 2.4 GHz operating band.

10. The antenna assembly of claim 1, wherein the first plane element is generally positioned in a first plane and the second plane element is generally positioned in a second plane above the first plane.

11. An antenna assembly, comprising:

a ground plane;

a first antenna; and a second antenna positioned orthogonally to the first antenna;

wherein each of the first and second antennas comprises:

a first plane element generally parallel with the ground plane and configured for operation in a first frequency band, the first plane element comprising a generally linear slot;

a first grounding element extending downwardly from the first plane element and electrically coupled to the ground plane;

a second grounding element extending downwardly from the first plane element and electrically coupled to the ground plane;

a feed element extending downwardly from the first plane element at a first end of the slot;

a second plane element connected to the first plane element, the second plane element generally parallel with the first plane element and the ground plane, and configured for operation in a second frequency band; and a connecting element extending downwardly from the second plane element to the first plane element.

12. The antenna assembly of claim 11, wherein the first plane element further comprises a first strip, a second strip, and a joining strip extending between the first and second strips, wherein the slot is formed between the first and second strips.

13. The antenna assembly of claim 12, wherein:

the first strip of the first plane element extends generally perpendicularly from the first grounding element to the joining strip; and the second strip of the first plane element extends generally perpendicularly from the second grounding element to the joining strip and a connecting element joining the first plane element to the second plane element.

14. The antenna assembly of claim 13, wherein the second strip of the first plane element is generally L-shaped when viewed in a direction transverse to the ground plane.

15. The antenna assembly of claim 13, wherein the second strip of the first plane element comprises:

a first portion extending generally perpendicularly from the second grounding element to the connecting element and a second portion; and the second portion extending generally perpendicularly from the first portion to the joining strip and generally parallel with the slot.

16. The antenna assembly of claim 12, wherein:

the first grounding element extends downwardly from the first strip;

the second grounding element extends downwardly from the second strip; and the feed element extends downwardly from the joining strip.

17. The antenna assembly of claim 11, wherein the second plane element comprises:

a first portion extending generally perpendicularly from the connecting element and generally parallel with the slot; and a second portion extending from an end of the first portion and generally perpendicular to the slot.

18. The antenna assembly of claim 11, wherein a first area of each of the first and second antennas on one side of the slot has a right hand circular polarization and a second area of each of the first and second antennas on the other side of the slot has a left hand circular polarization.

19. The antenna assembly of claim 11, wherein the first plane element is generally positioned in a first plane and the second plane element is generally positioned in a second plane above the first plane.

* * * * *